US008697217B2

(12) United States Patent
Loyack et al.

(10) Patent No.: US 8,697,217 B2
(45) **Date of Patent: *Apr. 15, 2014**

(54) CREEP-RESISTANT POLISHING PAD WINDOW

(75) Inventors: Adam Loyack, Philadelphia, PA (US); Alan Nakatani, Lansdale, PA (US); Mary Jo Kulp, Newark, DE (US); David G. Kelly, Ambler, PA (US)

(73) Assignee: Rohm and Haas Electronics Materials CMP Holdings, Inc., Newark, DE (US)

( * ) Notice: Subject to any disclaimer, the term of this patent is extended or adjusted under 35 U.S.C. 154(b) by 696 days.

This patent is subject to a terminal disclaimer.

(21) Appl. No.: 12/657,202

(22) Filed: Jan. 15, 2010

(65) Prior Publication Data

US 2011/0177758 A1 Jul. 21, 2011

(51) Int. Cl.
*B24B 49/00* (2012.01)

(52) U.S. Cl.
USPC ..... 428/64.1; 451/6

(58) Field of Classification Search
CPC ..... B24B 37/013; B24B 37/205
USPC ..... 428/64.1; 451/6
See application file for complete search history.

(56) References Cited

U.S. PATENT DOCUMENTS

| | | | | |
|---|---|---|---|---|
| 5,605,760 | A | 2/1997 | Roberts | |
| 5,893,796 | A | 4/1999 | Birang et al. | |
| 6,752,690 | B1 * | 6/2004 | Fruitman | 451/6 |
| 6,866,559 | B2 | 3/2005 | Lehman et al. | |
| 6,875,077 | B2 | 4/2005 | Petroski et al. | |
| 6,984,163 | B2 * | 1/2006 | Roberts | 451/6 |
| 7,182,670 | B2 | 2/2007 | Muldowney | |
| 7,264,536 | B2 | 9/2007 | Wiswesser et al. | |
| 7,547,243 | B2 | 6/2009 | Wiswesser et al. | |
| 7,874,894 | B2 * | 1/2011 | Fukuda et al. | 451/6 |

FOREIGN PATENT DOCUMENTS

WO WO 2007132854 A1 * 11/2007

OTHER PUBLICATIONS

Copending U.S. Appl. No. 12/482,182, filed Jun. 10, 2009.

* cited by examiner

*Primary Examiner* — Gerard Higgins
(74) *Attorney, Agent, or Firm* — Blake T. Biederman

(57) ABSTRACT

The polishing pad is useful for polishing at least one of magnetic, optical and semiconductor substrates. The polishing pad includes a polishing layer having a polyurethane window. The polyurethane window has a cross-linked structure formed with an aliphatic or cycloaliphatic isocyanate and a polyol in a prepolymer mixture. The prepolymer mixture is reacted with a chain extender having OH or $NH_2$ groups and having an OH or $NH_2$ to unreacted NCO stoichiometry less than 95%. The polyurethane window has a time dependent strain less than or equal to 0.02% when measured with a constant axial tensile load of 1 kPa at a constant temperature of 60° C. at 140 minutes, a Shore D hardness of 45 to 90 and an optical double pass transmission of at least 15% at a wavelength of 400 nm for a sample thickness of 1.3 mm.

7 Claims, 6 Drawing Sheets

CREEP-RESISTANT POLISHING PAD WINDOW

BACKGROUND OF THE INVENTION

The invention relates to polymeric windows used in polishing pads for polishing with optical endpoint detection equipment. For example, the polishing pads are particularly useful for polishing endpoint detection of at least one of magnetic, optical, and semiconductor substrates.

Typically, semiconductor manufacturers use endpoint detection in chemical mechanical polishing (CMP) processes. In each CMP process, a polishing pad in combination with a polishing solution, such as an abrasive-containing polishing slurry or an abrasive-free reactive liquid, removes excess material in a manner that planarizes or maintains flatness for receipt of a subsequent layer. The stacking of these layers combines in a manner that forms an integrated circuit. The fabrication of these semiconductor devices continues to become more complex due to requirements for devices with higher operating speeds, lower leakage currents and reduced power consumption. In terms of device architecture, this translates to finer feature geometries and increased numbers of metallization levels. These increasingly stringent device design requirements are driving the adoption of smaller and smaller line spacing with a corresponding increase in pattern density. The devices' smaller scale and increased complexity have led to greater demands on CMP consumables, such as polishing pads and polishing solutions. In addition, as integrated circuits' feature sizes decrease, CMP-induced defectivity, such as, scratching becomes a greater issue. Furthermore, integrated circuits' decreasing film thickness requires that semiconductor fabricators do not introduce defects through over-polishing.

Over-polishing between semiconductor layers can result in copper interconnect "dishing" and dielectric "erosion". Dishing refers to the excessive metal removed from an interconnect—dished metal interconnects have a dish-shaped profile worn away during polishing. Dishing has the adverse effect of increasing resistance and excessive dishing can result in immediate or early device failure. Dielectric erosion refers to the general loss of dielectric that can occur during over-polishing. For example, dielectrics and especially low-k dielectrics have a tendency to wear when not protected by a hardmask. Over the last several years, manufacturers of silicon integrated circuits have been using endpoint detection to prevent excessive over-polishing.

Endpoint detection typically relies upon a signal such as a laser or light signal sent through a polymeric sheet, such as that described by John V. H. Roberts in U.S. Pat. No. 5,605,760 (Roberts '760) to provide an accurate polishing endpoint. Although the polyurethane window of the Roberts '760 pad is still in use today, it lacks the optical transmission required for demanding applications. Furthermore, when these windows are formed in situ by casting polyurethane polishing material around a solid polyurethane window, they can cause problems by bulging during polishing. Window bulging represents the window bending upward or outward from the polishing platen; and a bulging window presses against the semiconductor wafer with increased force to create a significant increase in polishing defects. A second generation window introduced in early 2009 contained a coefficient of thermal expansion or CTE where the window CTE matched the pad CTE. Although this window solved the bulge issue, it also lacked the optical transmission required for demanding polishing applications.

Aliphatic isocyanate-based polyurethane materials, such as those described in U.S. Pat. No. 6,984,163 provided improved light transmission over a broad light spectrum. Unfortunately, these aliphatic polyurethane windows tend to lack the requisite durability required for demanding polishing applications. There is a need for a polishing window that possesses high optical transmission, lacks outward window bulging and has the required durability for demanding polishing applications.

STATEMENT OF THE INVENTION

Figure 1:
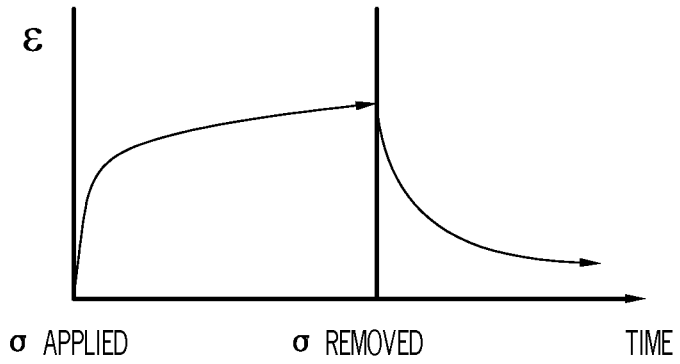
FIG. 1 represents a schematic plot of a typical time dependent strain response of a non-cross-linked-viscoelastic polymer.

In one aspect of the invention, a polishing pad useful for polishing at least one of magnetic, optical and semiconductor substrates, comprising a polishing layer, the polishing layer having a polyurethane window, the polyurethane window having a cross-linked structure formed with an aliphatic or cycloaliphatic isocyanate and a polyol in a prepolymer mixture, the prepolymer mixture being reacted with a chain extender having OH or $NH_2$ groups, and having an OH or $NH_2$ to unreacted NCO stoichiometry less than 95%, the polyurethane window having a time dependent strain less than or equal to 0.02% when measured with a constant axial tensile load of 1 kPa at a constant temperature of 60° C. at 140 minutes, a Shore D hardness of 45 to 80 and an optical double pass transmission of at least 15% at a wavelength of 400 nm for a sample thickness of 1.3 mm.

In another aspect of the invention, a polishing pad useful for polishing at least one of magnetic, optical and semiconductor substrates, comprising a polishing layer, the polishing layer having a polyurethane window, the polyurethane window having a cross-linked structure formed with an aliphatic or cycloaliphatic isocyanate and a polyol in a prepolymer mixture, the prepolymer mixture being reacted with a chain extender having OH or $NH_2$ groups, and having an OH or $NH_2$ to unreacted NCO stoichiometry less than 90%, the polyurethane window being metastable, the polyurethane window having a negative time dependent strain when measured with a constant axial tensile load of 1 kPa at a constant temperature of 60° C. at 140 minutes, a Shore D hardness of 50 to 80 and an optical double pass transmission of at least 15% at a wavelength of 400 nm for a sample thickness of 1.3 mm.

DETAILED DESCRIPTION

The polishing pad of the invention is useful for polishing at least one of magnetic, optical and semiconductor substrates. In particular, the polyurethane pad is useful for polishing semiconductor wafers; and in particular, the pad is useful for polishing advanced applications such as copper-barrier or shallow trench isolation (STI) applications that require end-point detection. For purposes of this specification, "polyurethanes" are products derived from difunctional or polyfunctional isocyanates, e.g. polyetherureas, polyisocyanurates, polyurethanes, polyureas, polyurethaneureas, copolymers thereof and mixtures thereof.

The polishing layer contains a polyurethane window that allows for optical endpoint detection of the surface being polished. A successful polyurethane window must meet several process requirements including acceptable optical transmission, low defect introduction to the polishing surface, and the ability to withstand polishing process conditions. In particular, this invention describes a creep-resistant, clear window. For purposes of this specification, "clear windows" are defined as polyurethane windows that allow for a double pass optical transmission of 15% or greater at 400 nm and "creep resistant" windows are defined as polyurethane windows having a time dependent strain less than or equal to 0.02% including negative strains when measured with a constant axial tensile load of 1 kPa at a constant temperature of 60° C. at 140 minutes. Similarly, "creep response" is defined as the time dependent strain measured with a constant axial tensile load of 1 kPa at a constant temperature of 60° C. For purposes of this specification, "time dependent strain" and "creep response" are being used interchangeably.

The polyurethane window is formed through reaction of at least one chain extender and one prepolymer. The prepolymers used for clear windows are produced through the reaction of an aliphatic or cycloaliphatic diisocyanate and a polyol in a prepolymer mixture. Preferred aliphatic polyisocyanates include, but are not limited to, methylene-bis(4 cyclohexylisocyanate) ("$H_{12}$MDI"), cyclohexyl diisocyanate, isophorone diisocyanate ("IPDI"), hexamethylene diisocyanate ("HDI"), propylene-1,2-diisocyanate, tetramethylene-1,4-diisocyanate, 1,6-hexamethylene-diisocyanate, dodecane-1,12-diisocyanate, cyclobutane-1,3-diisocyanate, cyclohexane-1,3-diisocyanate, cyclohexane-1,4-diisocyanate, 1-isocyanato-3,3,5-trimethyl-5-isocyanatomethylcyclohexane, methyl cyclohexylene diisocyanate, triisocyanate of hexamethylene diisocyanate, triisocyanate of 2,4,4-trimethyl-1,6-hexane diisocyanate, uretdione of hexamethylene diisocyanate, ethylene diisocyanate, 2,2,4-trimethylhexamethylene diisocyanate, 2,4,4-trimethylhexamethylene diisocyanate, dicyclohexylmethane diisocyanate, and mixtures thereof. The preferred aliphatic polyisocyanate has less than 14 wt % unreacted isocyanate groups.

Exemplary polyols include, but are not limited to the following: polyether polyols, hydroxy-terminated polybutadiene (including partially/fully hydrogenated derivatives), polyester polyols, polycaprolactone polyols, and polycarbonate polyols.

In one preferred embodiment, the polyol includes polyether polyol. Examples include, but are not limited to, polytetramethylene ether glycol ("PTMEG"), polyethylene propylene glycol, polyoxypropylene glycol, and mixtures or copolymers thereof. The hydrocarbon chain can have saturated or unsaturated bonds and substituted or unsubstituted aromatic and cyclic groups. Preferably, the polyol of the present invention includes PTMEG. Suitable polyester polyols include, but are not limited to, polyethylene adipate glycol, polybutylene adipate glycol, polyethylene propylene adipate glycol, o-phthalate-1,6-hexanediol, poly (hexamethylene adipate) glycol, and mixtures thereof. The hydrocarbon chain can have saturated or unsaturated bonds, or substituted or unsubstituted aromatic and cyclic groups. Suitable polycaprolactone polyols include, but are not limited to, 1,6-hexanediol-initiated polycaprolactone, diethylene glycol initiated polycaprolactone, trimethylol propane initiated polycaprolactone, neopentyl glycol initiated polycaprolactone, 1,4-butanediol-initiated polycaprolactone, PTMEG-initiated polycaprolactone, and mixtures thereof. The hydrocarbon chain can have saturated or unsaturated bonds, or substituted or unsubstituted aromatic and cyclic groups. Suitable polycarbonates include, but are not limited to, polyphthalate carbonate and poly(hexamethylene carbonate) glycol. The hydrocarbon chain can have saturated or unsaturated bonds, or substituted or unsubstituted aromatic and cyclic groups.

Advantageously, the chain extender is a polyamine, such as a diamine. Preferred polyamines include, but are not limited to, diethyl toluene diamine ("DETDA"), 3,5-dimethylthio-2,4-toluenediamine and isomers thereof, 3,5-diethyltoluene-2,4-diamine and isomers thereof, such as 3,5-diethyltoluene-2,6-diamine, 4,4'-bis-(sec-butylamino)-diphenylmethane, 1,4-bis-(sec-butylamino)-benzene, 4,4'-methylene-bis-(2-chloroaniline), 4,4'-methylene-bis-(3-chloro-2,6-diethylaniline) ("MCDEA"), polytetramethyleneoxide-di-p-aminobenzoate, N,N'-dialkyldiamino diphenyl methane, p,p'-methylene dianiline ("MDA"), m-phenylenediamine ("MPDA"), methylene-bis 2-chloroaniline ("MBOCA"), 4,4'-methylene-bis-(2-chloroaniline) ("MOCA"), 4,4'-methylene-bis-(2,6-diethylaniline) ("MDEA"), 4,4'-methylene-bis-(2,3-dichloroaniline) ("MDCA"), 4,4'-diamino-3,3'-diethyl-5,5'-dimethyl diphenylmethane, 2,2',3,3'-tetrachloro diamino diphenylmethane, trimethylene glycol di-p-aminobenzoate, and mixtures thereof. Preferably, the chain extender of the present invention includes DETDA. Suitable polyamine chain extenders include both primary and secondary amines.

In addition, other chain extenders such as, a diol, triol, tetrol, or other hydroxy-terminated chain extender may be added to the polyurethane composition. Suitable diol, triol, and tetrol groups include ethylene glycol, diethylene glycol, polyethylene glycol, propylene glycol, polypropylene 1,3-bis-{2-[2-(2-hydroxyethoxy)ethoxy]ethoxy}benzene, 1,4-butanediol, 1,5-pentanediol, 1,6-hexanediol, resorcinol-di-(beta-hydroxyethyl)ether, hydroquinone-di-(beta-hydroxyethyl)ether, and mixtures thereof. Preferred hydroxy-terminated chain extenders include 1,3-bis(2-hydroxyethoxy)benzene, 1,3-bis-[2-(2-hydroxyethoxy)ethoxy] benzene, 1,3-bis-{2-[2-(2-hydroxyethoxy)ethoxy] ethoxy}benzene, 1,4-butanediol, and mixtures thereof. Both the hydroxy-terminated and amine chain extenders can include one or more saturated, unsaturated, aromatic, and cyclic groups. Additionally, the hydroxy-terminated and amine chain extenders can include halogenation. The polyurethane composition can be formed with a blend or mixture of chain extenders, such as hydroxy-terminated compounds and amines. If desired, however, the polyurethane composition may be formed with a single chain extender.

Cross-linking of the "polyurethane" can occur through multiple mechanisms. One such mechanism is to reduce the amount of the chain extender in relation to the ratio of the isocyanate groups in the prepolymer. For example, reducing the ratio of the hydroxyl or amine groups in the chain extender to the aliphatic isocyanate groups of the prepolymer to less than 95% increases cross-linking. Specifically, the prepolymer mixture has an OH or $NH_2$ to unreacted NCO stoichiometry less than 95% to promote cross-linking. Advantageously, the prepolymer mixture has an OH or $NH_2$ to unreacted NCO stoichiometry less than 90% to promote cross-linking. Most advantageously, the prepolymer mixture has an OH or $NH_2$ to unreacted NCO stoichiometry of 75 to 90% to promote cross-linking. These ratios will result in excess aliphatic isocyanate groups once the chain extender is consumed. Excess isocyanate groups react with polyurethane and polyurea segments of the polymer chain during curing to link polymer chains. A second such mechanism is to use a prepolymer containing greater than two unreacted aliphatic isocyanate groups. The curing reaction of prepolymers containing greater than two functional groups results in a beneficial structure that is more likely to be crosslinked, as opposed to the more linear chain extension associated with prepolymers containing two functional groups. A third such mechanism is to use either a polyol or polyamine with greater than two functional groups, such as a polyol containing a tri-functional group, either as the chain extender or in combination with the chain extender. One aspect of this invention is to increase cross-linking through one or more of these mechanisms to improve the creep resistance of the window. Cross-linking increases the dimensional stability of the polyurethane window while maintaining adequate transmission at wavelengths below 500 nm.

The polyurethane window having a time dependent strain less than or equal to 0.02% when measured with a constant axial tensile load of 1 kPa at a constant temperature of 60° C. at 140 minutes. This amount of time dependent strain allows a window to perform during polishing without excessive deformation. Optionally, metastable polyurethanes serve to further increase creep resistance. For purposes of this specification, metastable represents a polyurethane that contracts in an inelastic fashion with temperature, stress or a combination of temperature and stress. For example, it is possible for incomplete curing of the polyurethane window or unrelieved stress associated with fabricating the window to result in a window contraction upon exposure to the stress and elevated temperatures experienced with semiconductor wafer polishing. The metastable polyurethane window can have a negative time dependent strain when measured with a constant axial tensile load of 1 kPa at a constant temperature of 60° C. at 140 minutes. This negative time dependent strain results in excellent creep resistance. The as-manufactured condition may include, but is not limited to, either the window manufacturing process, the pad manufacturing process, or some combination thereof. One such example is to cast and cure the window material with careful control over the cast technique and thermal cycle during curing, machine the block to the desired shape, position the window block within a much larger mold, casting the pad material into the mold and around the machined window block, cure the combined pad and window material under a carefully controlled thermal cycle, then skive the cake into sheets that will be used as polishing surfaces. Advantageously, the window has a partial cured morphology.

The window has a Shore D hardness of 45 to 80. This hardness range provides sufficient rigidity for demanding applications without the excessive hardness associated with increased defectivity. Advantageously, the window has a Shore D hardness of 50 to 80. Most advantageously, the window has a Shore D hardness of 55 to 75. For purposes of this specification, all physical properties represent values arising from samples conditioned at room temperature for three days at 50% relative humidity.

In addition to the physical properties, the window must also possess suitable double pass optical properties. The window has an optical double pass transmission of at least 15% at a wavelength of 400 nm at a sample thickness of 1.3 mm. Advantageously, the window has an optical double pass transmission of at least 18% at a wavelength of 400 nm at a sample thickness of 1.3 mm.

EXAMPLES

A series of window blocks were cast from various aromatic and aliphatic polyurethanes. In the following Examples, Samples A to D represent comparatives examples and Sample 1 represents the invention. Table 1 lists the formulations tested.

TABLE 1

| | Prepolymer | | Chain | Stoichiometry |
|---|---|---|---|---|
| Sample | Polyol | Diisocyanate | Extender | (%) |
| A | PTMEG/ DEG | TDI/ $H_{12}$MDI | MBOCA | 78% |
| B | PTMEG | $H_{12}$MDI | DETDA | 95% |
| C | PTMEG | $H_{12}$MDI | DETDA | 105% |
| D | PTMEG | $H_{12}$MDI | DETDA | 95% |
| 1 | PTMEG | $H_{12}$MDI | DETDA | 80% |

Table 2 summarizes the optical and creep properties of the pads described in Table 1. Additional data include glass transition temperature (Tg) and hardness measurements. These parameters were included to demonstrate that creep and optical properties were varied independent of other window physical properties. Cross-link density was quantified through a solvent swell test, where lower values designate increased cross-linking.

TABLE 2

| Properties | Sample A | Sample B | Sample C (105%) | Sample D (95%) | Sample 1 (80%) |
|---|---|---|---|---|---|
| Optical Properties: | | | | | |
| Double Pass Light Transmission @ 400 nm | <10% | 38% | 33% | 28% | 19% |
| Double Pass Light Transmission @ 800 nm | 22% | 44% | 39% | 34% | 24% |
| Time dependent Strain: | | | | | |
| Strain @ 140 min, As Manufactured | −0.05% | 0.04% | 0.04% | 0.03% | −0.01% |

TABLE 2-continued

| Properties | Sample A | Sample B | Sample C (105%) | Sample D (95%) | Sample 1 (80%) |
|---|---|---|---|---|---|
| Strain @ 140 min, Annealed | 0.04% | 0.10% | 0.07% | 0.06% | 0.02% |
| Physical Properties: | | | | | |
| Tg | 46° C. | 53° C. | 45° C. | 52° C. | 47° C. |
| Hardness | 71 Shore D | 67 Shore D | 69 Shore D | 70 Shore D | 67 Shore D |
| Cross-Link Density Surrogate | | | | | |
| Linear Swell | 1.72 | NA | 2.20 | 1.67 | 1.41 |

NA = Not Applicable/Dissolved in Test

Optical Property Measurements: Optical properties were determined using an HR4000 Composite-grating Spectrometer in combination with two LED sources each centered at 405 nm and 800 nm, respectively, and produced by Ocean Optics, Inc. Measurements were taken when light was emitted at the lower surface of the window, allowed to transmit through the window, reflected off of a surface positioned against the upper window surface, transmitted back through the window, and measured at the point of origin. One-hundred percent transmission was defined as the measured intensity when a length of air equal to the window thickness is tested in a similar manner. This passing the light twice through the window is also known as "double pass" transmission. Similarly, "single pass" transmission is the square root of the double pass transmission.

Creep Measurements: The tensile creep experiment measured the time dependent strain, $\epsilon(t)$, of a sample subjected to a constant applied stress, $\sigma_0$. The time dependent strain is the extent of deformation of the sample and is defined by $\Delta L(t)/L_0 \times 100\%$. The applied stress is defined as the applied force, F, divided by the cross-sectional area of the test specimen. The tensile creep compliance, D(t), is defined as follows:

$$D(t)=\epsilon(t)/\sigma_0.$$

Creep compliance is typically reported on the log scale. Since some of the experimental values were negative and the log of a negative number cannot be defined, strain values are reported in lieu of creep compliance. Since both values are synonymous under constant stress, the strain values reported have technical significance.

The creep compliance is plotted as a function of time and a textbook example of the creep response (strain) of a viscoelastic polymer as a function of time is shown in FIG. 1. The stress, $\sigma$, is applied at t=0. The polymer initially deforms in an elastic fashion and continues to slowly stretch (creep) with time (left curve). When the stress is removed, the polymer recoils (right curve). A viscoelastic material does not fully retract, whereas a purely elastic material returns to its initial length.

Creep measurements were performed on a TA Instruments Q800 DMA using tensile clamp fixtures. All creep experiments were performed at 60° C. to simulate the polishing temperature. Samples were allowed to equilibrate at the test temperature for 15 minutes before applying stress. The stress applied to the sample was 1 kPa. The dimensions of each test specimen were measured using a micrometer before testing. Nominal sample dimensions were typically 18 mm×6 mm×2 mm. The stress was applied to the sample for 150 minutes. After 150 minutes, the applied stress was removed and measurements were continued for another 60 minutes. The creep compliance and sample strain were recorded as a function of time. The window material supplied for testing originated from manufactured integral window pads. Pieces of the window material were cut from the pads for testing. Samples were tested as-received ("As-Manufactured") and after annealing in an oven overnight (16 hrs) at 60° C. ("Annealed").

Differential Scanning calorimetry: The glass transition temperature of the polyurethane window was determined using a TA Q1000 differential scanning calorimeter, with a 15 mg sample of polyurethane encapsulated in an aluminum hermetic pan. A heating ramp from −90° C. to 250° C. at 10° C./min was applied. The $T_g$ was determined by inflection using Universal Analysis Software V 2.4.

Cross-Link Density Surrogate: Cross-link density directionality was assessed using a solvent swell test. As a good solvent (in the Flory sense) is absorbed by the polymer sample, the polymer chains will migrate until they are restricted by the connection to another polymer chain (i.e. cross-linking). If a sample has little or no cross-linking, the polymer chains continue to spread until the sample loses structural integrity or is dissolved by the solvent. Cross-linked polymers have restricted chain movement, thus, swelling decreases with increased cross-linking.

Swell testing was performed by soaking the polymer sample in N-Methyl-2-pyrrolidone ("NMP") at 60° C. for 24 hours and measuring the diameter of the sample both prior to and after soaking. Linear swell is defined as the soaked sample diameter at 24 hours divided by the initial sample diameter as follows:

$$\text{Linear Swell}=D(24\text{ hr})/D_o$$

Samples were prepared by removing the polyurethane window material from an integral window pad and modifying the dimension to a diameter of 12.7 mm and thickness of 1.3 mm

Example 1

Comparative Window A

Figure 2:
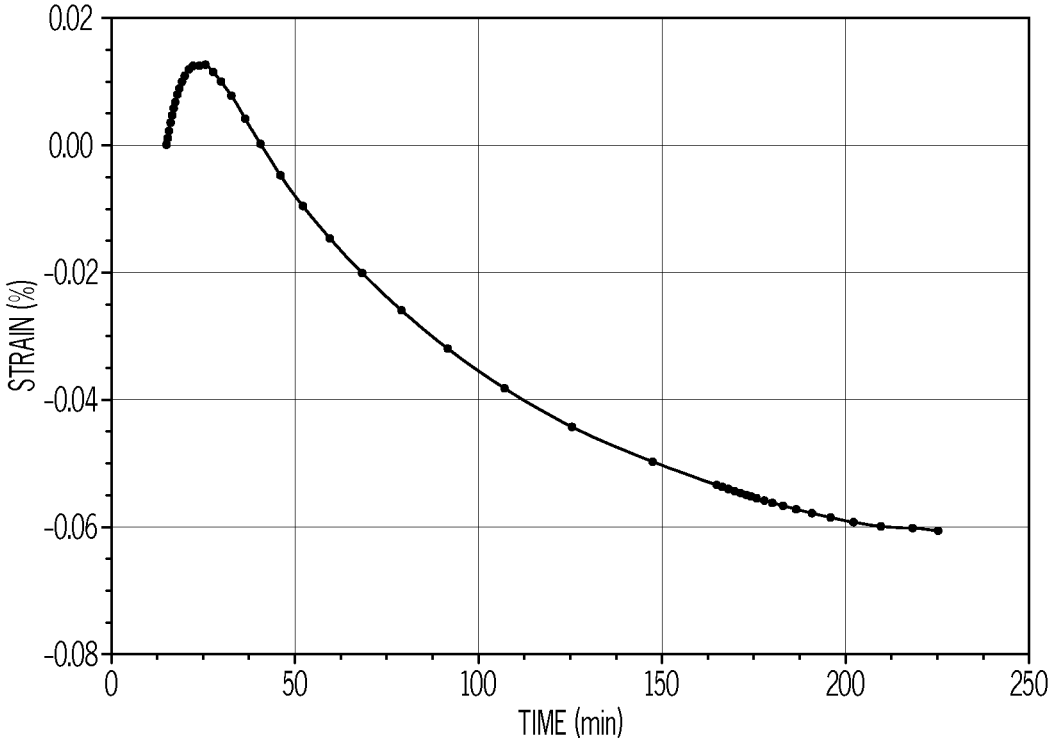
FIG. 2 represents a plot of the time dependent strain response for an as-manufactured Comparative Window A.
Figure 3:
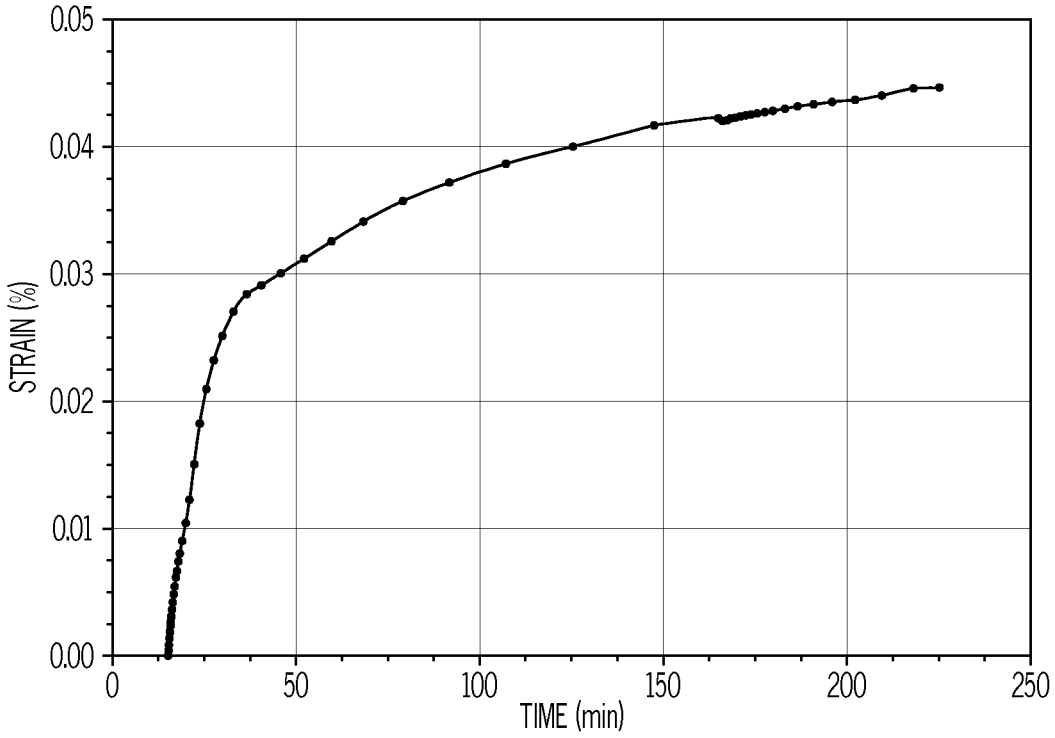
FIG. 3 represents a plot of the time dependent strain response for an annealed Comparative Window A.

Comparative Window A was a commercially available window designed for use with an optical end point detection device that did not require transmission below 500 nm. The cross-linked polymer consisted of a prepolymer mixture containing aromatic and aliphatic isocyanate and an aromatic chain extender. The negative time dependent creep response of the as-manufactured sample is shown in FIG. 2. Instead of a continuous stretching of the sample with time as shown schematically in FIG. 1, the time dependent strain response of Window A shows a retraction of the sample along the extension direction as evidenced by the negative strain values. This retraction demonstrated a metastable polyurethane that retracted with time and temperature. The time dependent strain response of an annealed sample of Comparative Window A is shown in FIG. 3. After annealing the sample, the time dependent strain response resembled the time dependent strain shown schematically in FIG. 1. Based on the values is Table 2, the metastable Comparative Window A had sufficient creep-resistance, but lacked the required double pass transmission. The annealed Comparative Window A lacked both the required creep resistance and the double pass transmission.

Example 2

Comparative Window B

Figure 4:
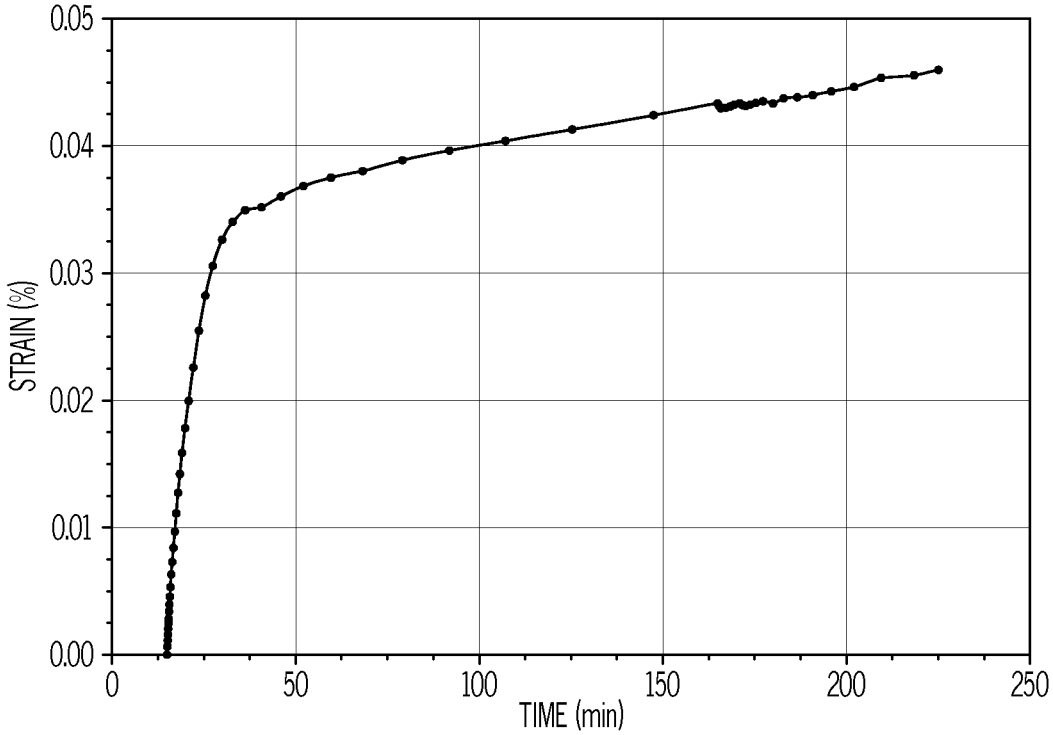
FIG. 4 represents a plot of the time dependent strain response for an as-manufactured Comparative Window B.
Figure 5:
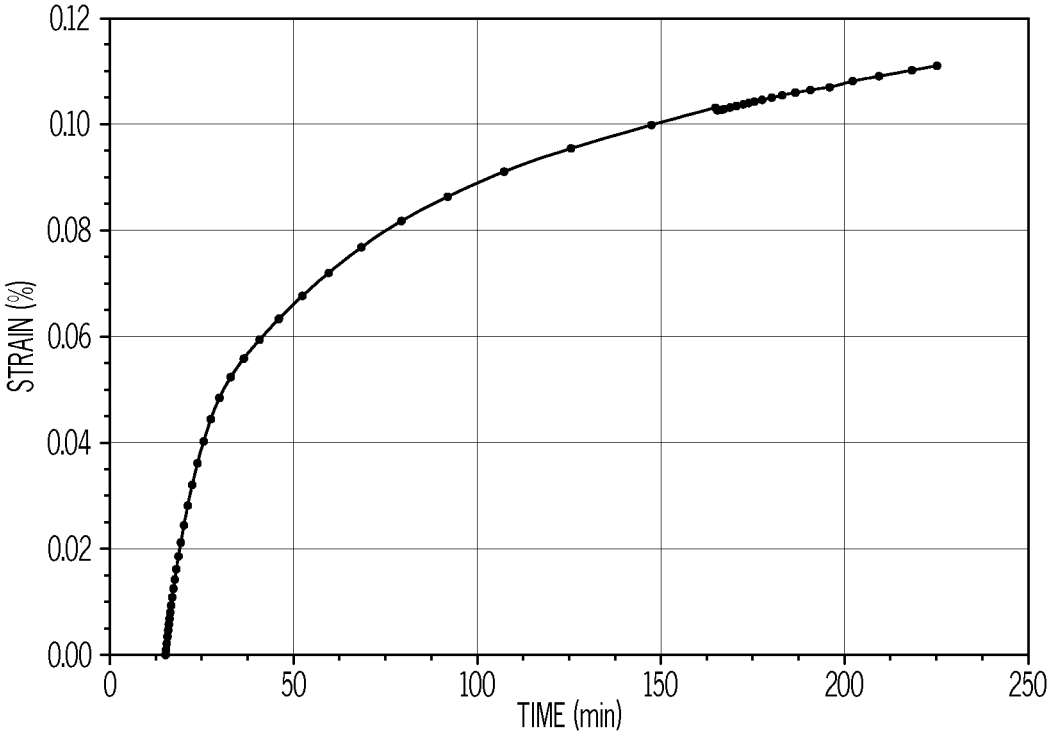
FIG. 5 represents a plot of the time dependent strain response for an annealed Comparative Window B. glycol, lower molecular weight polytetramethylene ether glycol, 1,3-bis(2-hydroxyethoxy)benzene, 1,3-bis-[2-(2-hydroxyethoxy)ethoxy]benzene.

Comparative Window B represented an experimental material designed for use with an optical end point detection device that required significant transmission below 500 mn. The polymer consisted of an aliphatic prepolymer and an aromatic chain extender. Despite having a stoichiometry of 95%, the polymer exhibited very low cross-linking as evidenced by the swell test results. It is possible that inadvertent exposure to atmospheric moisture increased the stoichiometry, thereby decreasing both the degree of cross-linking and the molecular weight. At completion of the swell test, the sample was dissolved within the solution. Therefore, the final dimensions could not be measured and the results were not applicable. The lack of cross-linking also resulted in a larger time dependent strain than Comparative Window A as illustrated in FIGS. 4, 5, and Table 2. Annealing the sample reduced the metastable state to show a further increase in time dependent strain. Comparative Window B lacked the required creep resistance for demanding window applications.

Example 3

Comparative Window C

Figure 6:
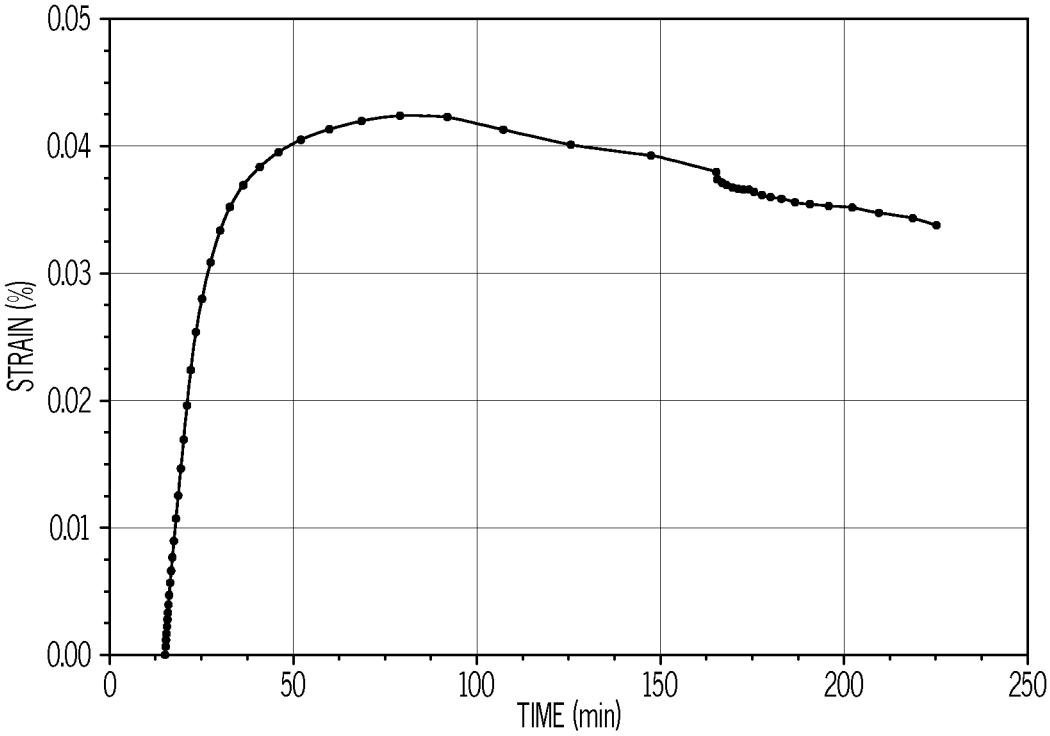
FIG. 6 represents a plot of the time dependent strain response for an as-manufactured Comparative Window C.
Figure 7:
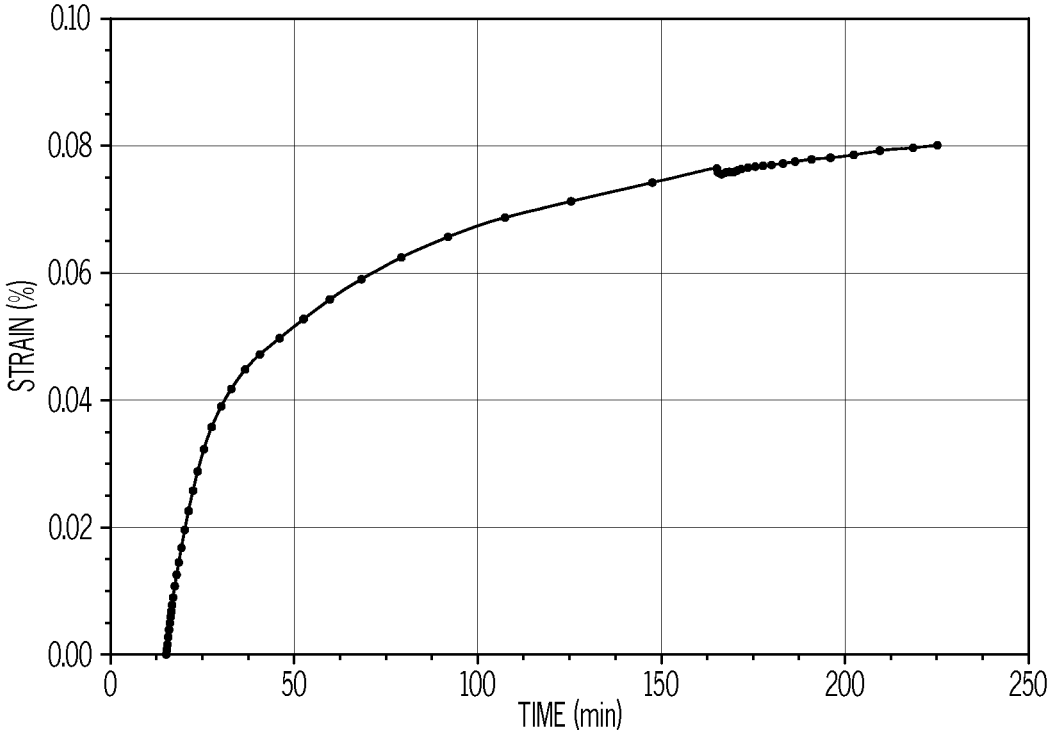
FIG. 7 represents a plot of the time dependent strain response for an annealed Comparative Window C.

Comparative Window C was a commercially available window designed for use with optical end point detection devices that required significant transmission below 500 nm. The cross-linked polymer consisted of an aliphatic prepolymer and an aromatic chain extender. Comparative Window B and Comparative Window C were manufactured from different prepolymers. Referring to FIGS. 6, 7, and Table 2, the time dependent strain did not provide sufficient creep resistance for demanding window applications in either the as-manufactured or annealed state. Although the material maintained its integrity in the linear swell test better than did Comparative Window B, it would not be expected to have the chemical cross-linking of Comparative Window A because it was prepared at greater than one hundred percent stoichiometry. As illustrated by the linear swell results, chain entanglements, sometimes termed "physical cross-links", may have contributed to the reduced time dependent strain of Comparative Windows A and C. For purposes of the specification, the term cross-link includes both chemical bonds and chain entanglements.

Example 4

Comparative Window D

Figure 8:
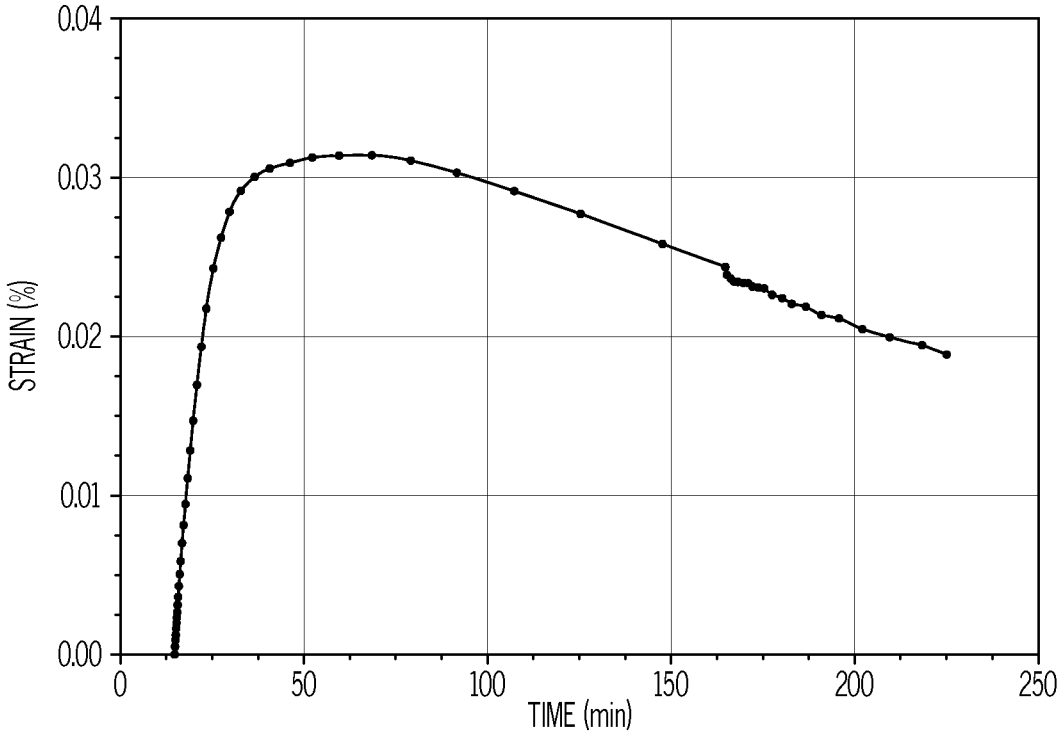
FIG. 8 represents a plot of the time dependent strain response for an as-manufactured Comparative Window D.
Figure 9:
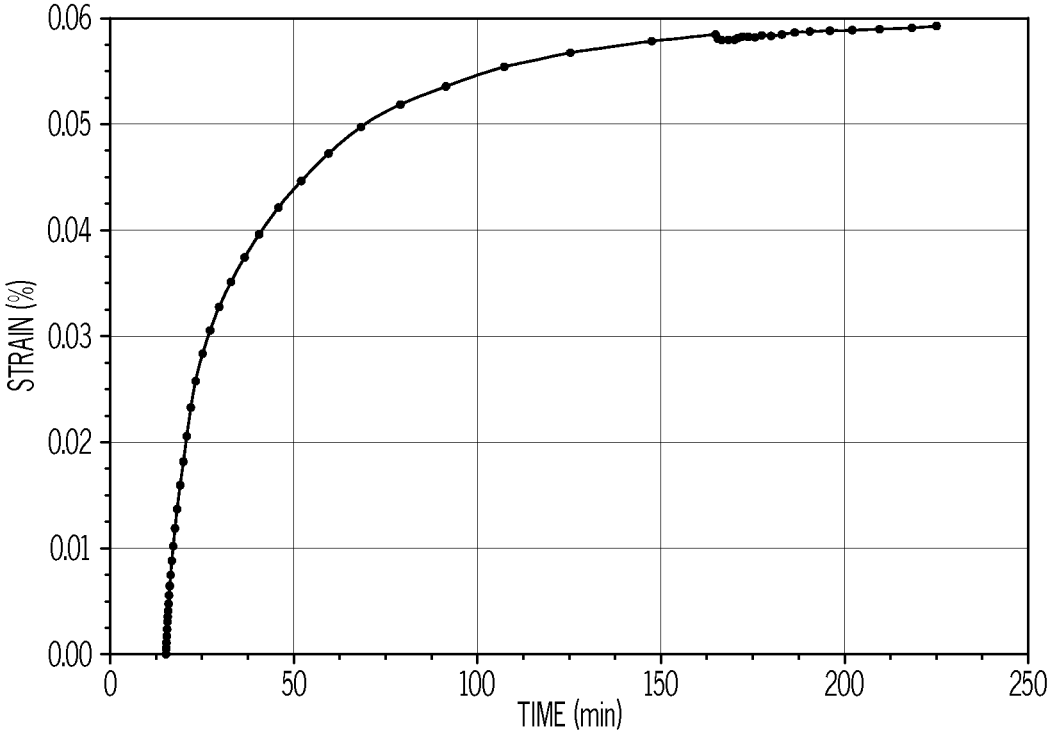
FIG. 9 represents a plot of the time dependent strain response for an annealed Comparative Window D.

Comparative Window D was a clear integral window designed for use with an optical end point detection device that required significant transmission below 500 nm. The material used the same prepolymer and chain extender as Comparative Window C, however, the stoichiometry was decreased to increase cross-linking and reduce creep response. Increased cross-linking was demonstrated by the reduced linear swell relative to Window C. This material was metastable as evident by the downward sloping strain curve shown in FIG. 8 and it did not meet the criteria for a "creep resistant" window suitable for demanding polishing applications per the as-manufactured strain response in Table 2. The time dependent strain response of Sample 1 after annealing to relieve the metastable condition is illustrated in FIG. 9.

Example 5

Example Window 1

Figure 10:
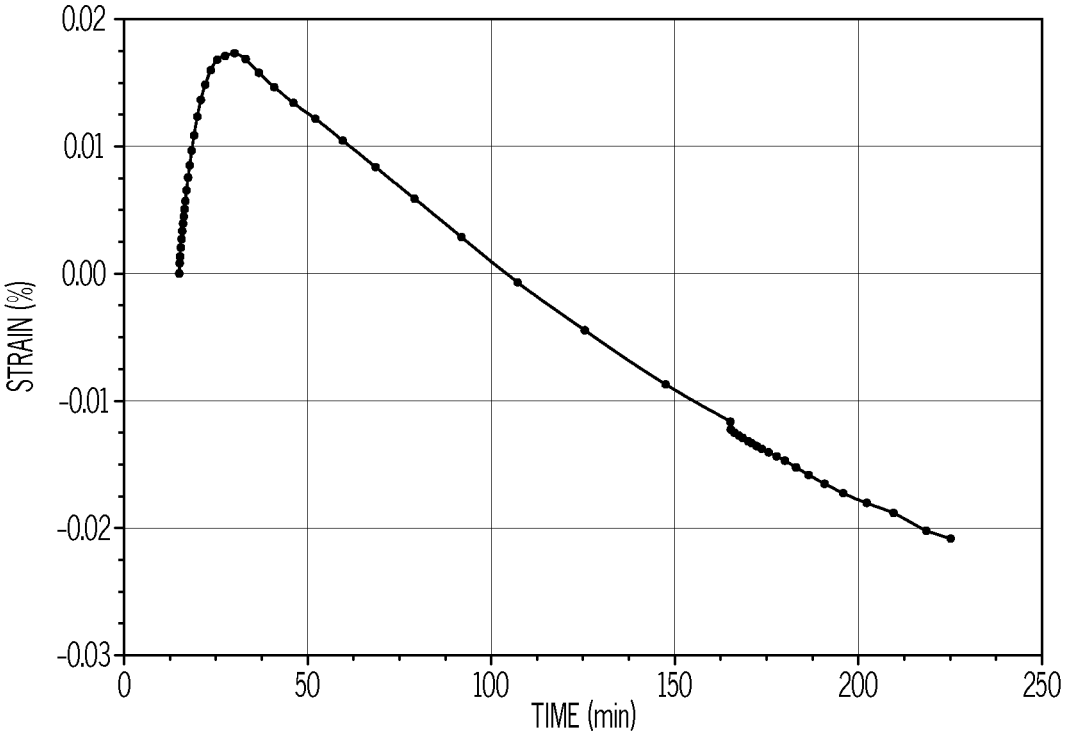
FIG. 10 represents a plot of the time dependent strain response for an as-manufactured Window 1.
Figure 11:
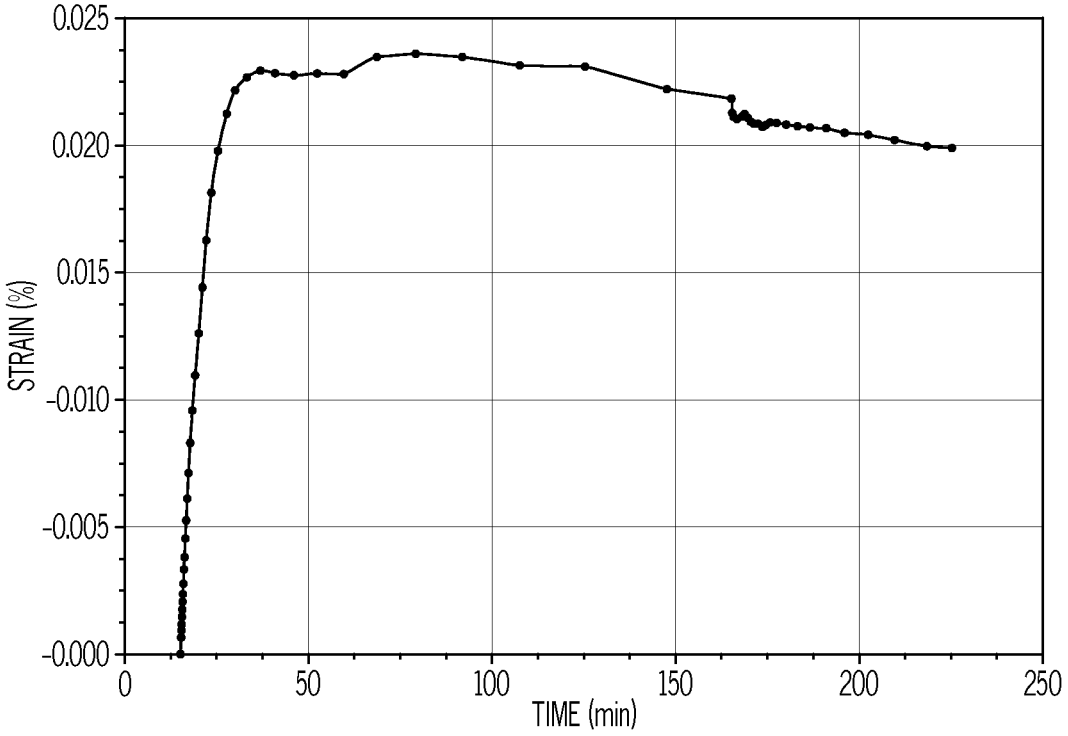
FIG. 11 represents a plot of the time dependent strain response for an annealed Window 1.

Example Window 1 was a clear integral window designed for use with an optical end point detection device that requires significant transmission below 500 nm. The material used the same prepolymer and chain extender as Comparative Windows C and D, however, the stoichiometry was further decreased to further increase cross-linking and reduce creep response. Similar to Comparative Window A, the strain of the material was negative in the as-manufactured, or metastable, state. FIG. 10 illustrates the negative time dependent strain response of the material in the as-manufactured state. The annealed strain response is illustrated in FIG. 11. Note that the annealed time dependent strain slope was larger than the as-manufactured slope due to partial relief of the metastable condition. The time dependent stress of the annealed material satisfied the criteria for a "creep resistant" window to demonstrate that increased cross-linking can produce a "creep resistant" window for demanding applications in combination with acceptable double pass light transmission.

The invention claimed is:

1. A polishing pad useful for polishing at least one of magnetic, optical and semiconductor substrates, comprising a polishing layer, the polishing layer having a polyurethane window, the polyurethane window having a cross-linked structure formed by reacting an aliphatic or cycloaliphatic isocyanate and a polyol to form a prepolymer and reacting the prepolymer with a chain extender consisting essentially of diethyl toluene diamine, 3,5-dimethylthio-2,4-toluenediamine and isomers thereof, 3,5-diethyltoluene-2,4-diamine and isomers thereof, 3,5-diethyltoluene-2,6-diamine, 4,4'-bis-(sec-butylamino)-diphenylmethane, 1,4-bis-(sec-butylamino)-benzene, 4,4'-methylene-bis-(2-chloroaniline), 4,4'-methylene-bis-(3-chloro-2,6-diethylaniline) ("MCDEA"), polytetramethyleneoxide-di-p-aminobenzoate, N,N'-dialkyldiamino diphenyl methane, p,p'-methylene dianiline ("MDA"), m-phenylenediamine ("MPDA"), methylene-bis 2-chloroaniline ("MBOCA"), 4,4'-methylene-bis-(2-chloroaniline) ("MOCA"), 4,4'-methylene-bis-(2,6-diethylaniline) ("MDEA"), 4,4'-methylene-bis-(2,3-dichloroaniline) ("MDCA"), 4,4'-diamino-3,3'-diethyl-5,5'-dimethyl diphenylmethane, 2,2',3,3'-tetrachloro diamino diphenylmethane, trimethylene glycol di-p-aminobenzoate, or mixtures thereof, and having an OH or $NH_2$ to unreacted NCO stoichiometry less than 95%, the polyurethane window having a time dependent strain less than or equal to 0.02% when measured with a constant axial tensile load of 1 kPa at a constant temperature of 60° C. at 140 minutes, a Shore D hardness of 45 to 80 and an optical double pass transmission of at least 15% at a wavelength of 400 nm for a sample thickness of 1.3 mm and wherein the polyurethane window has a partial cured morphology.

2. The polishing pad of claim 1 wherein the polyurethane window is metastable with a negative time dependent strain.

3. The polishing pad of claim 1 wherein the prepolymer includes greater than two isocyanate groups.

4. A polishing pad useful for polishing at least one of magnetic, optical and semiconductor substrates, comprising a polishing layer, the polishing layer having a polyurethane window, the polyurethane window having a cross-linked structure formed by reacting an aliphatic or cycloaliphatic isocyanate and a polyol to form a prepolymer, and reacting the prepolymer with a chain extender consisting essentially of diethyl toluene diamine, 3,5-dimethylthio-2,4-toluenediamine and isomers thereof, 3,5-diethyltoluene-2,4-diamine and isomers thereof, 3,5-diethyltoluene-2,6-diamine, 4,4'-bis-(sec-butylamino)-diphenylmethane, 1,4-bis-(sec-butylamino)-benzene, 4,4'-methylene-bis-(2-chloroaniline), 4,4'-methylene-bis-(3-chloro-2,6-diethylaniline) ("MCDEA"), polytetramethyleneoxide-di-p-aminobenzoate, N,N'-dialkyl-diamino diphenyl methane, p,p'-methylene dianiline ("MDA"), m-phenylenediamine ("MPDA"), methylene-bis 2-chloroaniline ("MBOCA"), 4,4'-methylene-bis-(2-chloroaniline) ("MOCA"), 4,4'-methylene-bis-(2,6-diethylaniline) ("MDEA"), 4,4'-methylene-bis-(2,3-dichloroaniline) ("MDCA"), 4,4'-diamino-3,3'-diethyl-5,5'-dimethyl diphenylmethane, 2,2',3,3'-tetrachloro diamino diphenylmethane, trimethylene glycol di-p-aminobenzoate, or mixtures thereof, and having an OH or $NH_2$ to unreacted NCO stoichiometry less than 90%, the polyurethane window being metastable, the polyurethane window having a negative time dependent strain when measured with a constant axial tensile load of 1 kPa at a constant temperature of 60° C. at 140 minutes, a Shore D hardness of 50 to 80 and an optical double pass transmission of at least 15% at a wavelength of 400 nm for a sample thickness of 1.3 mm and wherein the polyurethane window has a partial cured morphology.

5. The polishing pad of claim 4 wherein the prepolymer includes greater than two isocyanate groups.

6. The polishing pad of claim 4 wherein the polyurethane window has an optical double pass transmission of at least 18%.

7. The polishing pad of claim 4 wherein the polyurethane window has a Shore D hardness of 55 to 75.

* * * * *